United States Patent [19]

Saruwatari et al.

[11] Patent Number: 4,759,805

[45] Date of Patent: Jul. 26, 1988

[54] ALUMINUM CONDUCTOR OF LOW AUDIBLE NOISE TRANSMISSION

[75] Inventors: Kohichi Saruwatari, Tokyo; Takeshi Saito, Numazu; Akira Okazato, Tokyo; Kozo Kounosu, Shimofusa; Tadashi Inoue, Shimofusa; Takanori Hita, Shimofusa; Masatsugu Maejima, Tokyo, all of Japan

[73] Assignee: Fujikura Cable Works Ltd., Japan

[21] Appl. No.: 942,065

[22] Filed: Dec. 16, 1986

Related U.S. Application Data

[63] Continuation of Ser. No. 603,995, Apr. 26, 1984, Pat. No. 4,759,805, which is a continuation of Ser. No. 244,620, Mar. 17, 1981, abandoned.

[30] Foreign Application Priority Data

Mar. 24, 1980 [JP] Japan ..... 55-037303

[51] Int. Cl.[4] ..... C23C 22/56

[52] U.S. Cl. ..... 148/6.27; 174/127; 174/128 R; 174/130; 427/118; 427/120

[58] Field of Search ..... 174/127, 128 R, 129 R, 174/130, 119 R, 119 C; 57/217, 221, 223; 148/6.27; 427/118, 120; 51/319, 320

[56] References Cited

U.S. PATENT DOCUMENTS

| | | | |
|---|---|---|---|
| 3,039,898 | 6/1962 | Keller | 148/6.14 R |
| 3,039,899 | 6/1962 | Keller | 148/6.14 R |
| 3,247,026 | 4/1966 | Switzer | 148/6.3 |
| 3,383,704 | 5/1968 | Schoerner et al. | 57/217 |
| 3,728,164 | 4/1973 | Abe | 148/6.3 X |
| 3,734,782 | 5/1973 | La Roche | 148/6.3 |
| 3,930,113 | 12/1975 | Johansen et al. | 174/40 R |
| 4,223,074 | 9/1980 | Yoshida et al. | 148/6.27 |
| 4,288,974 | 9/1981 | Eistrat | 57/217 |
| 4,292,095 | 9/1981 | Schlinsog | 148/6.14 R |
| 4,358,637 | 11/1982 | Lanfranconi | 174/127 |
| 4,383,133 | 5/1983 | Lanfranconi | 174/127 |
| 4,463,219 | 7/1984 | Sato | 174/127 |

FOREIGN PATENT DOCUMENTS

| | | | |
|---|---|---|---|
| 517066 | 4/1951 | Canada . | |
| 549885 | 12/1957 | Canada | 174/127 |
| 692386 | 8/1964 | Canada . | |
| 692286 | 8/1964 | Canada . | |
| 894187 | 2/1972 | Canada | 427/292 |
| 986453 | 3/1976 | Canada . | |
| 398516 | 7/1924 | Fed. Rep. of Germany | 174/127 |
| 36-14076 | 8/1961 | Japan . | |
| 36-14185 | 8/1961 | Japan . | |
| 0018307 | 2/1981 | Japan | 174/127 |
| 56-30207 | 3/1981 | Japan . | |
| 6091309 | 7/1981 | Japan | 174/127 |

OTHER PUBLICATIONS

Comber, M. G. and Zaffanella, L. E.; "Audible-Noise Reduction by Bundle Geometry Optimization"; Presentation IEEE Power Engineering Society Winter Meeting; New York, N.Y.; Jan. 28-Feb. 2, 1973 printed Nov. 1972; pp. 1782-1789.

Uchiyama, T. et al; Wettability Behavior of Various Aluminum Surface Treatments; "Noise and Fluids Engineering".

"Aluminum Study Journal"; No. 2, vol. 146, 1980; by Journal of the Japanese Anodizing Association.

Wilson, G. L.; "High Voltage-Generated Noise"; *Noise and Fluids Engineering;* American Society of Mechanical Engineers; Winter Annual Meeting, Atlanta, Georgia; Nov. 27-Dec. 2, 1977; pp. 53-58.

*Primary Examiner*—Morris H. Nimmo

*Attorney, Agent, or Firm*—Darby & Darby

[57] ABSTRACT

The surface of an aluminum conductor is roughened, for example, by blasting. A hydrophilic film such as a boehmite film, an anodic oxide film and a chemical conversion film is formed on the roughened surface. A protective film made of a wetting agent or a hydrophilic resin is formed on the hydrophilic film. The conductor may comprise a compressed aluminum conductor.

2 Claims, 5 Drawing Sheets

ALUMINUM CONDUCTOR OF LOW AUDIBLE NOISE TRANSMISSION

This is a continuation of application Ser. No. 603,995, filed Apr. 26, 1984, now U.S. Pat. No. 4,759,805 which is a continuation of application Ser. No. 244,620, filed Mar. 17, 1981, now abandoned.

BACKGROUND OF THE INVENTION

1. Field of the Invention

This invention relates to aluminum conductors of UHV transmission lines.

2. Prior Art

Oil or grease tends to adhere to the surface of aluminium conductors of UHV transmission lines during the manufacture thereof. If such a conductor is laid in the air, water drops, for a certain period of time, collect on the conductor surface during and immediately after a rainfall because of the presence of the oily material adhered to the conductor surface. As a result, the conductor surface gets wet unevenly. This gives rise to corona discharges which cause a great audible noise. This problem has been serious particularly in residential areas. Conventionally, the oily material is removed from the conductor surface, using cloth or the like, after the aluminum conductor is strung in the air in order to prevent the corona discharges, thereby reducing the audible noise. However, this procedure has been found not wholly satisfactory. In addition, it has proven to be quite difficult to remove the oily material from the conductor surface since this removing operation is carried out at locations high in the air.

It has been proposed in the art to treat the conductor surface so that water drops, collecting on the surface during and immediately after a rainfall, are caused to dissipate quickly, thereby causing the conductor surface to get wet uniformly. One such method is known from Japanese Patent Publication No. 36-14185 in which the surfaces of wires constituting a conductor are treated by sand blasting so that rain drops on the conductor surface are caused to disperse, thereby preventing rain drops of relatively large diameter from collecting on the conductor surface and also dissipating the rain water on the conductor surface. With this method, however, rain drops of small diameter are still present on the conductor surface, and as a result a satisfactory water dissipation is not achieved. Another method is known from Japanese Patent Publication No. 36-14076 in which a film of a hydrophilic compound having a hydroxyl group is coated on wires constituting a conductor so that the wettability of the conductor surface is enhanced to prevent the collection of rain drops thereon. With this method, however, the rain drops are caused to spread slowly over the conductor surface, and the extent of spreading of the rain drops is small. As a result, the conductor surface fails to get wet uniformly. Thus, the above-mentioned known methods have also been unsatisfactory in that the generation of audible noise is not fully prevented.

SUMMARY OF THE INVENTION

With the above deficiencies of the prior art in view, it is an object of this invention to provide an aluminum conductor in which an audible noise caused by corona discharges is reduced to a minimum.

According to the present invention, there is provided an aluminum conductor having a roughened surface on which a hydrophilic film is formed.

The surface of the aluminum conductor is first roughened, for example, by blasting. The roughened surface is then coated with a hydrophilic film, such as a boehmite film, an anodic oxide film, a chromate film and a chemical conversion film, to impart a hydrophilic nature thereto. Further, the thus treated conductor is coated with a protective film made, for example, of a wetting agent, a hydrophilic resin or the like. A compressed aluminum conductor having a smooth body may be used as the conductor.

DETAILED DESCRIPTION OF THE INVENTION

Figure 1:
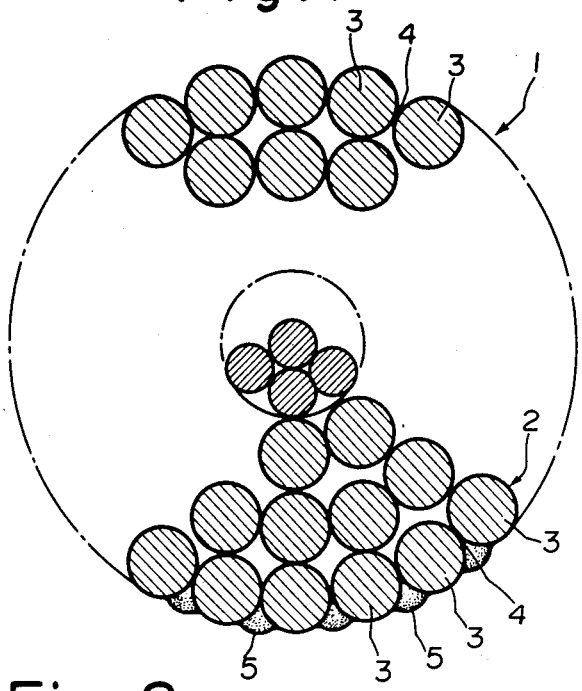
FIG. 1 is a cross-sectional view of a conventional aluminum conductor.

As an aluminum conductor, an aluminum cable steel-reinforced (ACSR) which comprises a galvanized steel wire or strand as a core and hard aluminum wires arranged around the steel core, a corrosion resistant ACSR and the like are used. The aluminum conductor is first subjected to a roughening treatment to have a roughened surface. The roughening treatment is carried out by blasting such as a sand blasting using siliceous sand or alumina and a shot blasting using grits, for example, of cast iron, or glass beads. The roughening treatment can also be carried out by a rotary wheel having an abrasive material such as steel wire and steel wool. The roughening treatment can also be carried out by satinizing, using suitable chemicals. The roughening treatment serves to impart closely spaced unevenness, i.e., fine pits and projections throughout the entire surface of the aluminus conductor so that the surface is made coarse. Surface roughness is preferably in the range of several $\mu$ to hundreds of $\mu$, and usually about 5 to 100$\mu$. The surface roughness varies with the size, hardness, properties, etc. of the aluminum conductor. Therefore, different roughening methods are used to carry out the surface roughening of different aluminum conductors. Processing conditions are determined so that the conductor has an optimum coarse surface. For example, when the roughening treatment is carried out by blasting, optimum particle size and particle shape of the blasting material, an optimum blasting pressure and an optimum blasting time are selected, so that the aluminum conductor has a desired roughened surface. Oil or grease adhered to the conductor surface during the manufacture thereof is removed therefrom by the roughening treatment. Subsequently, a hydrophilic film is formed on the roughened surface of the aluminum conductor. As the hydrophilic film, a boehmite film by a boehmite treatment, an anodic oxide film by anodizing, a chromate film or zinc phosphate film by chemical conversion and the like are used. The boehmite film is obtained by subjecting the roughened conductor surface to weak alkali boiling water or steam of which pH is adjusted to 8.5 to 10 by adding a small amount of alkali substance such as ammonia, triethanol amine and diethylamine. Alternatively, the conductor surface is subjected to deionized boiling water or steam. The boehmite film thus obtained is composed of hydroxides representative of $(AlO.OH)_2$ or $Al_2O_3.H_2O$ and has a thickness of 0.05 to 2$\mu$. The film is non-porous and has a smooth surface, and exhibits an excellent hydrophilic nature.

The anodic oxide film is obtained by electrolysis. A water solution of acid such as oxalic acid and sulfuric acid is used as an electrolyte. The aluminum conductor serves as the positive electrode (the anode). The film so obtained is amorphous and representative of $Al_2O_3$. The film is porous and has a thickness of 1 to 100$\mu$, and exhibits an excellent hydrophilic nature. This film may be subjected to a sealing treatment, using boiling water, steam or the like. The film so treated also exhibits an excellent hydrophilic nature and is suitable for the aluminum conductor film.

The chemical conversion film is obtained, for example by dipping the aluminum conductor with the roughened surface in a chromic acid solution to produce a chromate film, by dipping the conductor in a zinc phosphate solution to produce a zinc phosphate film, by a MBV method in which the conductor is dipped in a solution of mixture of sodium carbonate, sodium chromate and causic soda, or by a BV method. These films are composed of aluminum hydroxides and one of chromium oxide hydrate, aluminum phosphate, zinc phosphate and aluminum fluoride. These films exhibit an excellent hydrophilic nature.

Among the above hydrophilic films, the boehmite film, obtained by a boehmite treatment in which the conductor is subjected to the deionized steam having a temperature of 100° to 120° C. for 0.5 to 20 minutes, is an optimum hydrophilic film. In addition, the boehmite treatment requires no chemicals and is suitable for producing a long aluminum conductor. Thus, the boehmite film is best suited for the industrial production of the intended aluminum conductor.

The aluminum conductor having the hydrophilic film exhibits an excellent wettability so that an audible noise caused by corona discharges is kept to a minimum. However, oil or grease tends to adhere to the hydrophilic film of the aluminum conductor during the manufacture thereof and at the time when the aluminum conductor is strung in the air at a construction site. Also, contaminants tend to adhere to the hydrophilic film of the conductor during storage thereof. As a result, a hydrophobic layer is formed on the hydrophilic film of the conductor so that the corona discharges are not sufficiently prevented from occuring. In order to overcome this difficulty, a protective film is formed on the hydrophilic film of the conductor. The formation of the protective film is carried out by coating the conductor with a solution of wetting agent or hydrophilic resin or by dipping it in such a solution. The wetting agents are preferably those which dissolve the contaminants or oily material on the conductor into water or emulsify the, contaminants to form O/W type emulsion. For example, wetting agents of the anion type include alkylsulfate and alkyl benzene sulfonate, and wetting agents of the nonionic type include polyoxy ethylene alkyl ether and polyoxy ethylene alkyl phenol ether. In order to enhance the bonding of the wetting agent to the aluminum conductor surface and to enhance the affinity for the contaminants or oily material, it is preferred that the wetting agent is in the liquid state. Where it is desired to coat the aluminum conductor with a corrosion proof oil during the manufacture thereof or at the time when the conductor is laid in the air at a construction site, the wetting agent may be dissolved or dispersed in the corrosion proof oil.

As the hydrophilic resin, polyvinyl alcohol, cellulose or the like is used. These resins are dissolved in a solvent such as hot water to form a solution, and this solution is applied to the hydrophilic film on the aluminum conductor surface by spraying, dipping or the like. Alternatively, a film of hydrophilic resin may be wound around the conductor, for example, by lapping.

The protective film made of the wetting agent or the hydrophilic resin prevents the conductor surface from having a hydrophobic nature due to the contaminants or oily material, and also causes the contaminants or oily material to be dissolved in water and be washed away during a rainfall so that the hydrophilic film on the conductor surface can retain an excellent hydrophilic nature as initially obtained for a prolonged period of time. In addition, the wetting agent or the hydrophilic resin serving as the protective film has a hydrophilic nature, and therefore this all the more enhance the wettability of the conductor.

Figure 2:
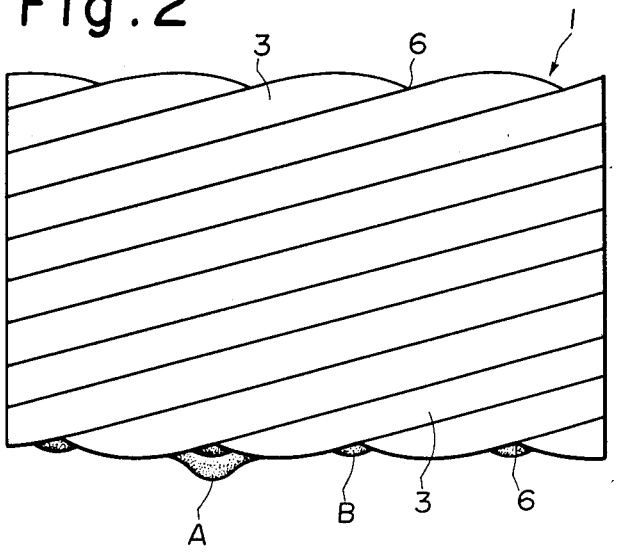
FIG. 2 is a fragmentary elevational view of the conductor.

Since an ACSR is used as the aluminum conductor 1, recesses 4 are formed on the outermost layer 2 of hard aluminum wires 3 as shown in FIG. 1, each recess being defined by the adjacent wires 3. The recesses 4 prevent the water drops from smoothly moving over the conductor surface, and the flowing and dropping of the rain drops are not achieved efficiently. Thus, the dissipation of the rain water is not satisfactory, and besides the rain drops 5 collect in the recesses 4. The surface of the aluminum conductor 1, when viewed from the side thereof as shown in FIG. 2, assumes corrugated contour. If water drops, collecting on the lower portion of the conductor 1, are sufficiently large as those indicated by A, such water drops A are moved horizontally along the lower portion of the conductor and gather together so that they fall in a large drop. However, if water drops are small as those indicated by B, such water drops B fail to move horizontally so that a satisfactory water dissipation is not achieved.

Thus, the collection of water drops on the conductor surface due to its configuration create a source of generation of corona discharges. Even if the conductor surface is subjected to a roughening treatment and a hydrophilic treatment, this disadvantage may not be entirely eliminated. In order to further facilitate the overcoming of this difficulty, a compressed aluminum conductor may be used as the conductor. The compressed aluminum conductor can be obtained by rolling a conductor using perpendicularly disposed two pairs of rolls or by drawing it using a die. Each pair of rollers have respective peripheral grooves of semicircular cross-section. The compressed conductor thus formed has a circular cross-section. The aluminum conductor is reduced in cross-section by this compressing operation. The reduction of area or cross-section is represented by the following equation:

$$R(\%) = \frac{S_0 - S_1}{S_0} \times 100$$

wherein R is a reduction of area, $S_o$ is the cross-section of the aluminum conductor, and $S_1$ is the cross-section of the compressed aluminum conductor. The aluminum conductor is compressed so that the reduction R of area is in the range of 1 to 30%. When the reduction R of area is less than 1%, recesses 8 in the conductor surface, which are defined by the aluminum wires 7 of the outermost layer 2, are not reduced satisfactorily, and the desired results are not obtained. On the other hand, when the reduction R of area exceeds 30%, the cross-section of the aluminum conductor is excessively small, and power transmission characteristics are adversely affected. First, an ACSR, which is larger in cross-section than a standard ACSR, is prepared and compressed by the die or the perpendicularly disposed two pairs of rolls so that the reduction of area is 1 to 30%. This compressed conductor has the same cross-section as the standard ACSR. The compressing operation is carried out after the aluminum conductor is formed. Alternatively, the aluminum wires are compressed, and the aluminum conductor is prepared, using these compressed wires.

Figure 3:
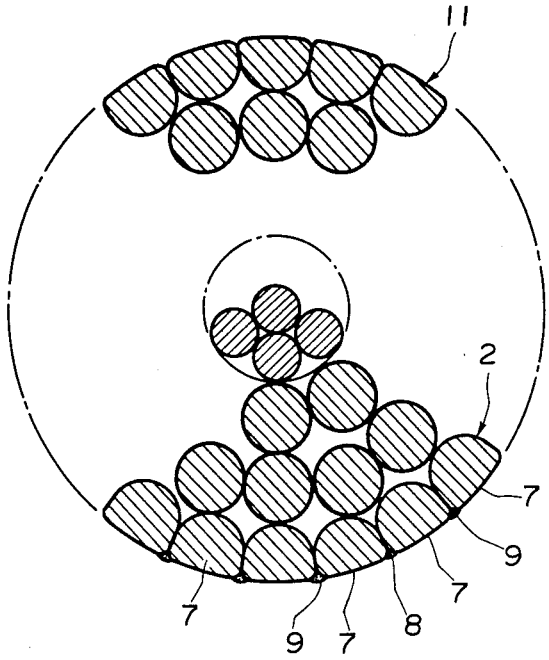
FIG. 3 is a cross-sectional view of a compressed aluminum conductor.
Figure 4:
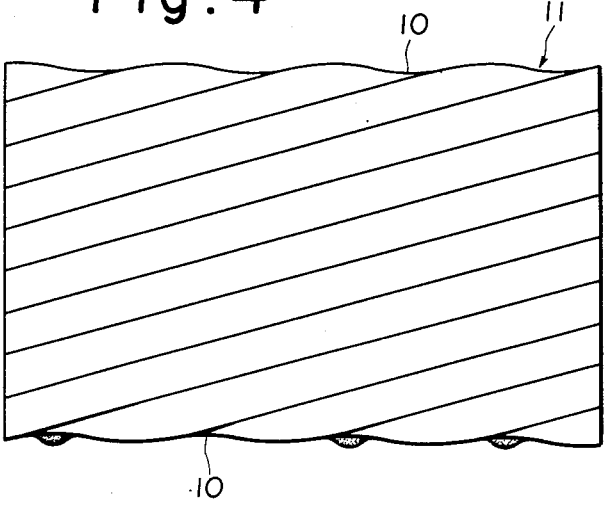
FIG. 4 is a fragmentary elevational view of the compressed aluminum conductor.

As shown in FIGS. 3 and 4, the compressed aluminum conductor 11 thus formed has small recesses 8 on its surface, the recesses 8 being defined by the aluminum wires 7 of the outermost layer 2. Therefore, the water drops on the conductor surface are hardly prevented by the recesses 8 from moving, thereby enhancing the flowing and falling of the water drops. As a result, a satisfactory water dissipation is achieved. Further, the amount of the water drop collecting in the recess 8 is small. As shown in FIG. 4, the corrugation 10 on the conductor surface is also rather smooth so that the water drops, collecting on the lower portion of the conductor, are easily moved horizontally along the surface. Therefore, a satisfactory water dissipation is achieved, and the compressed aluminum conductor 11 give rise to less audible noise caused by corona discharges. Further, since the conductor surface is roughened and has a hydrophilic nature, the flowing and spreading of the water drops are prompted. This accelerates the flowing and falling of the water drops so that the generation of corona discharges are efficiently prevented.

The invention will now be illustrated by the following examples:

EXAMPLE 1

ACSRs of 810 mm² cross-section were subjected to roughening and hydrophilic treatments under conditions shown in Table 1 to prepare various samples. The color tone of the surfaces of the samples was observed. Also, the wettability of the surfaces was observed by dropping water thereon. The results obtained are shown in Table 2.

TABLE 1

| Sample NO. | Blasting treatment (#100 Alundum) | Boehmite treatment (Steam of 120° C.) NONE | 30 sec. | 1 min. | 3 min. |
|---|---|---|---|---|---|
| $A_0$ | 0 | 0 | | | |
| $A_1$ | 0 | | 0 | | |

TABLE 1-continued

| Sample NO. | Blasting treatment (#100 Alundum) | Boehmite treatment (Steam of 120° C.) NONE | 30 sec. | 1 min. | 3 min. |
|---|---|---|---|---|---|
| $A_2$ | 0 | | | 0 | |
| $A_3$ | 0 | | | | 0 |
| $B_0$ | | 0 | | | |
| $B_1$ | | | 0 | | |
| $B_2$ | | | | 0 | |
| $B_3$ | | | | | 0 |

TABLE 2

| Sample No. | Surface appearance | Wettability |
|---|---|---|
| $A_0$ | No luster. No oily material. Mathe finish. | Water drops remained immediately after applying water. 3 minutes later, water dissipation was finished throughout the surface. |
| $A_1$ | The whole surface exhibited intervention color. The color became darkened. | No water drop left about 2 minutes after applying water. |
| $A_2$ | The color became darkened and turned lizard color | No water drop left about 1 minute after applying water. |
| $A_3$ | The color became darkened and turned lizard color | Most of water drops disappeared immediately after applying water, and disappeared completely 1 minute later. |
| $B_0$ | Films of lubricating oil and corrosion proof oil adhered to the surface during the manufacture were left. | Water drops distributed over the surface and remained even 10 min. after applying water. |
| $B_1$ | Spots appeared where oily materials existed. Slight intervention color. | Water dissipation was pretty good. A small number of water drops left. Almost all of water drops fell 5 min. later. |
| $B_2$ | Lizard color. Darkish spots appeared where oily materials existed. | Water dissipation was very good. Almost no water drops left 1 min. later. |
| $B_3$ | Intervention color. Lizard color. The surface assumed greyish color on the whole. | No water drop left 15 sec. after applying water. |

Figure 5:
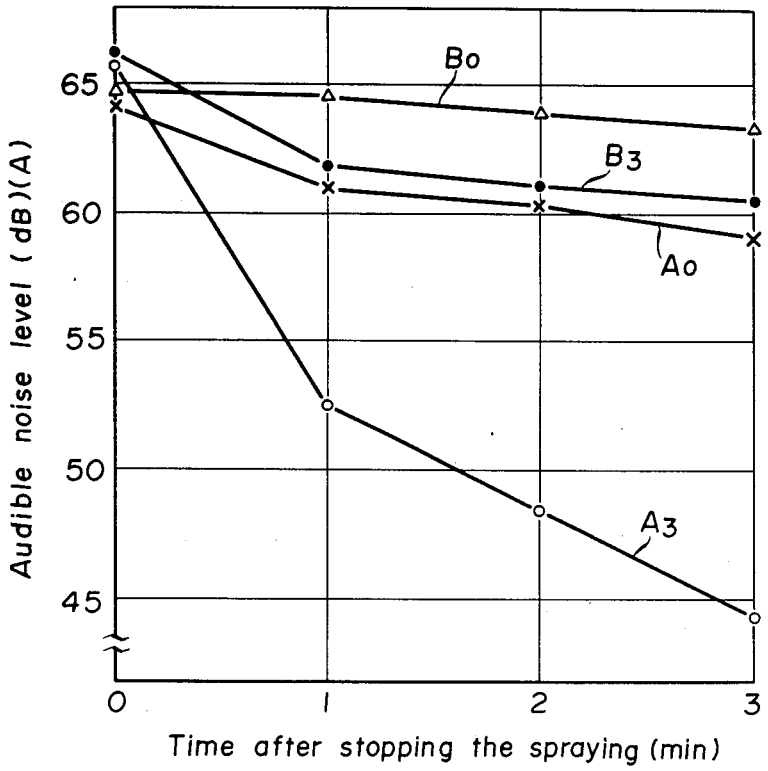
FIG. 5 is a graph representing the relation between an audible noise level and time after spraying.

The above samples $A_o$, $A_3$, $B_o$ and $B_3$ were energized, spraying water thereto by a cylindrical corona test cage. The attenuation of audible noise level of these samples for three minutes after stopping the spraying was measured at a voltage gradient of 12.8 KV/cm. The results obtained were shown in FIG. 5.

EXAMPLE 2

Figure 6:
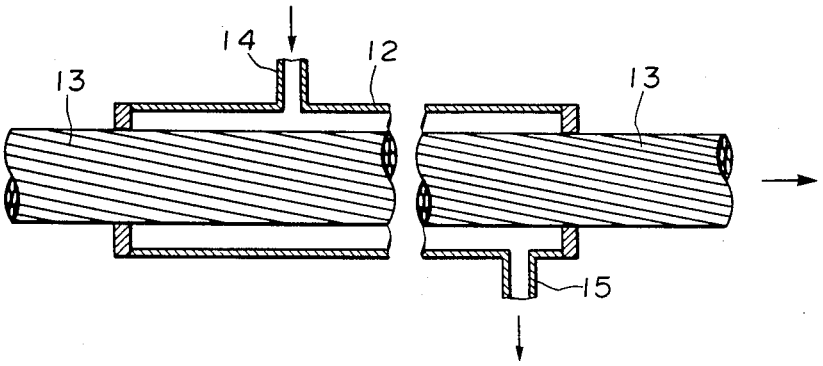
FIG. 6 is a cross-sectional view of a boehmite treatment device.
Figure 7:
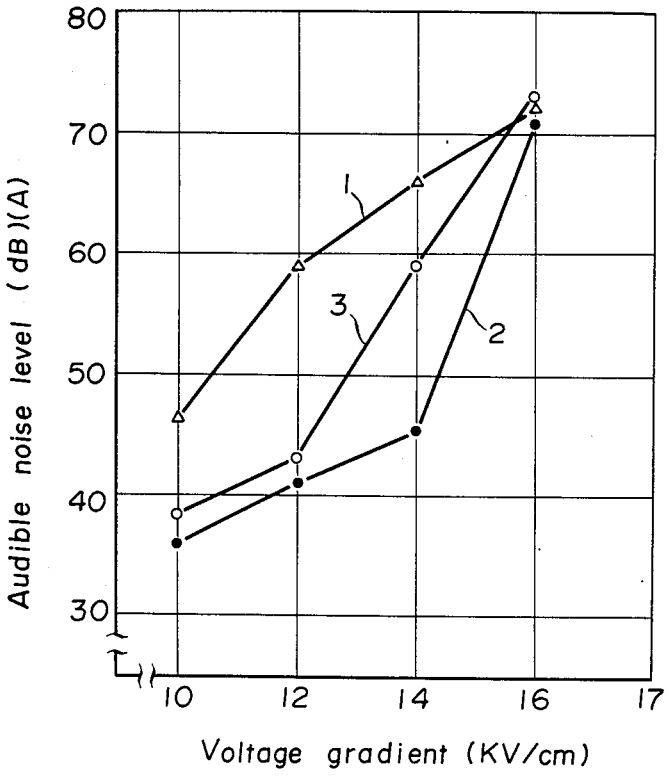
FIG. 7 is a graph representing the relation between an audible noise level and a surface voltage gradient.

Sample (1) was prepared by coating ACSR (810 mm² cross-section, 10 m long) with Emulgen 404 (ether type nonionic wetting agent sold by Kao Atlas Chemical Co., Ltd.) and rinsing the thus treated ACSR in clean water to remove oil, grease or contaminants adhered to the surface during the manufacture thereof. Sample (2) was prepared by subjecting sample (1) to a blasting treatment for 45 seconds by means of a wet blasting machine using Alundum #100 (alumina; particle size 150 to 180μ), dipping the so treated ACSR in a water solution of 0.5 vol. % ethanole amine at a temperature of 90° to 95° C. for five minutes, rinsing the so treated ACSR in clean water, and drying the rinsed ACSR. Sample (3) was prepared by subjecting sample (1), which is indicated at 13 in FIG. 6, to the blasting treatment, described above for sample (2), by means of a boehmite treatment device 12, and applying steam to the thus treated ACSR for five minutes. The steam temperature was 105° C. at the inlet 14 of the device 12 into which the steam was introduced, and was 100° C. at the outlet 15 from which the steam was discharged. These samples (1), (2) and (3) were energized, varying the surface voltage gradient, and water was sprayed thereto at a rate of 30 mm/hour, using a cylindrical corona test cage. The audible noise level of the samples three minutes after stopping the spraying was measured. The results obtained are shown in FIG. 7. As is clear from FIG. 7, the audible noise of sample (2) is reduced by several dB to more than ten dB in comparison with a blank ACSR.

EXAMPLE 3

Figure 8:
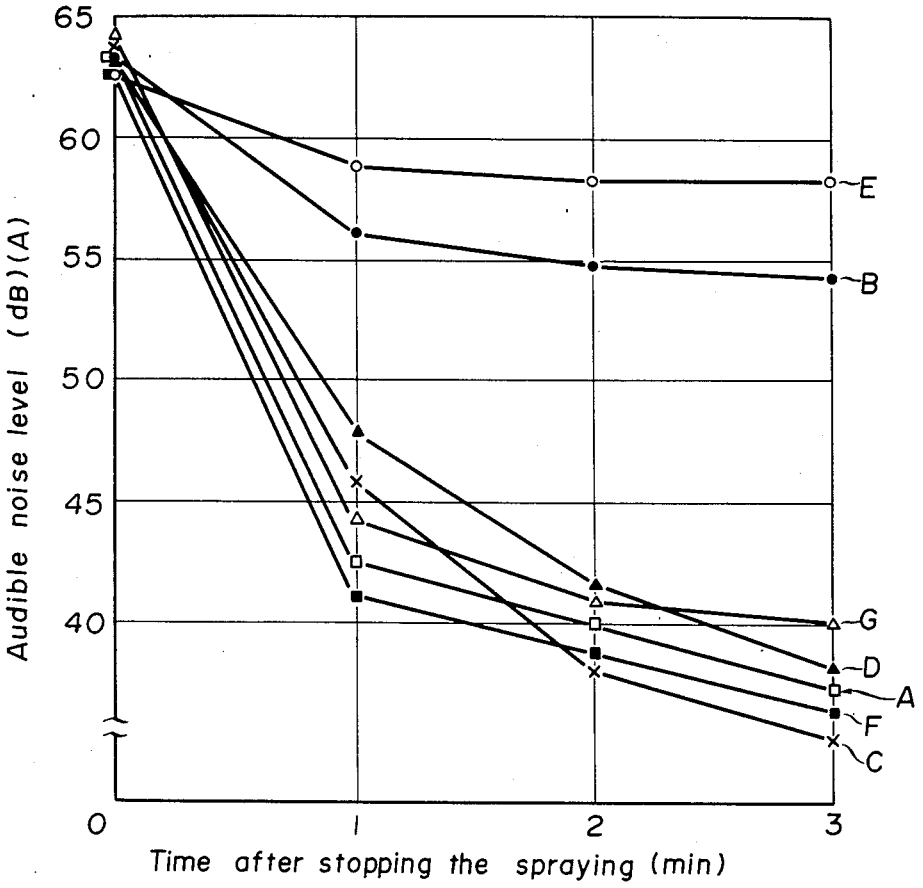
FIG. 8 is a graph representing the relation between an audible noise level and time after spraying.

Samples of aluminum conductors were prepared under various conditions mentioned below. These samples were energized, and water was sprayed thereto at a rate of 30 mm/hour, using a cylindrical corona test cage. The attenuation of audible noise level of the samples for three minutes after stopping the spraying was measured at a voltage gradient of 12.8 KV/cm. The results obtained are shown in FIG. 8.

Sample A was prepared by subjecting ACSR of 810 $mm^2$ cross-section to a blasting treatment by means of Alundum #100 particles, steam-treating the ACSR in a pressure vessel for 30 minutes at a pressure of 4 $kg/cm^3$, and coating the thus treated ACSR with a boehmite film. Sample A was tested immediately after it was prepared.

Sample B was prepared by leaving sample A in a room under relatively bad conditions for six months.

Sample C was prepared by coating sample A with Emulgen 404 (ether type nonionic wetting agent) to form a thin film on the surface, and leaving the thus treated ACSR in a room for six months under the same conditions described above for sample B. Immediately before this sample was used for testing, it was rinsed with water to wash away the wetting agent and air-dried.

Sample D was prepared by coating sample A with a water solution of 3% polyvinyl alcohol (Denka Poval K-24 sold by Denki Kagaku Kogyo Co., Ltd.) and drying it. This sample was left in a room for six months under the same conditions described above for sample B, and was rinsed with water to wash away the coating of polyvinyl alcohol and air-dried immediately before it was subjected to testing.

Sample E was prepared by coating sample A with a corrosion proof oil.

Sample F was prepared by coating sample A with Emulgen 404 as a wetting agent. This sample was rinsed with water to wash away the wetting agent immediately after it was coated on the surface, and was air-dried.

Sample G was prepared by coating sample A with polyvinyl alcohol (Denka Poval K-24), coating a corrosion proof oil on the thus treated surface, rinsing the so treated surface with water to wash away polyvinyl alcohol, and air-drying the so treated ACSR.

Figure 1A:
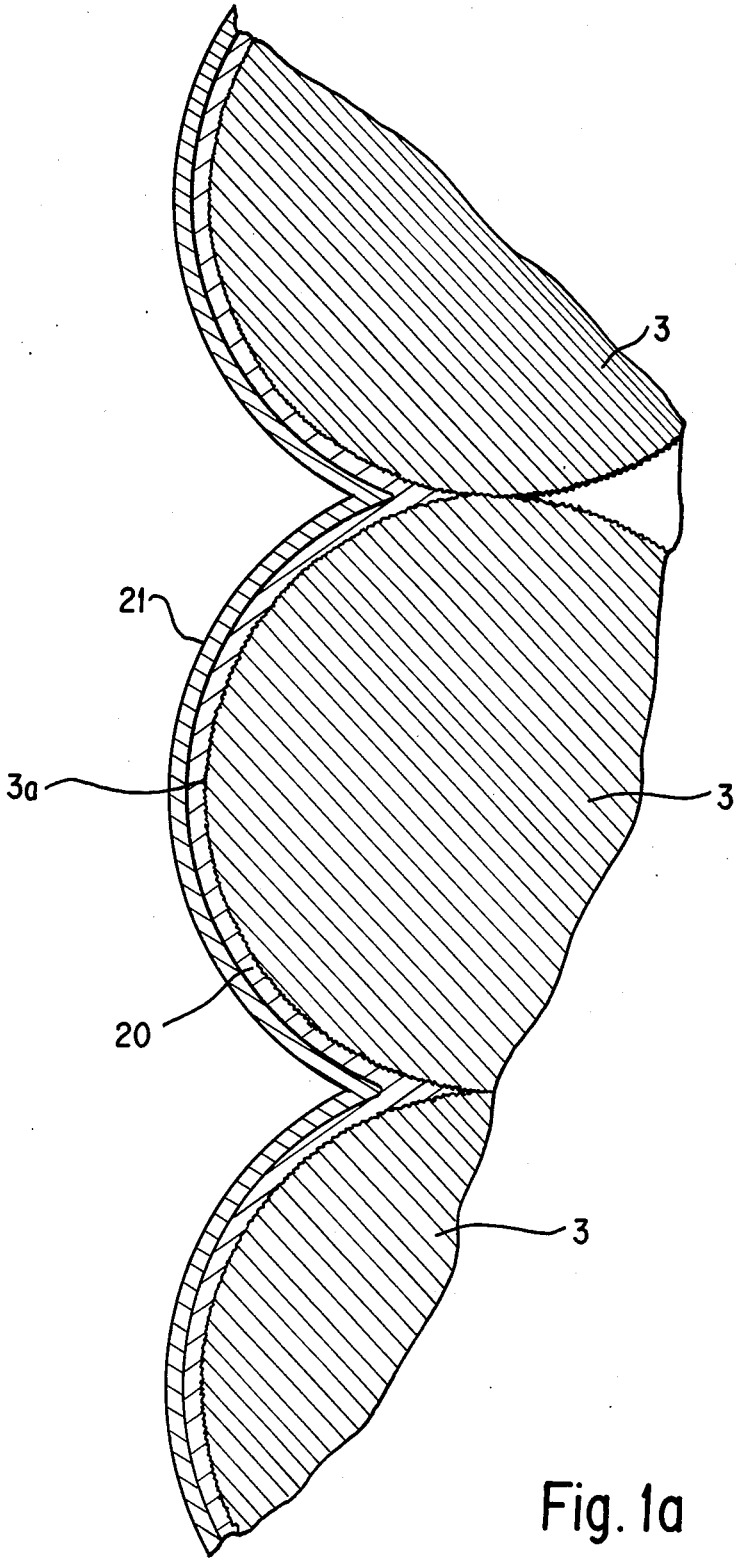
FIG. 1*a* is an enlarged fragmentary view of a cable of the general type shown in FIG. 1 which illustrates one embodiment of the present invention.

As shown in FIG. 8, sample A, which was subjected to the roughening treatment and to the test immediately after the hydrophilic film was formed on the surface, shows excellent noise level. As is clear from sample B, sample A exhibits a hydrophobic nature with the lapse of time and show poor noise level. Samples C and D (See FIG. 1*a*), including a roughness 3*a* on the surface of wires 3, a hydrophilic film 20 and a protective film 21 according to the invention retain excellent noise level for a prolonged period of time. This indicates that the present invention is quite advantageous. As is clear from sample F, the aluminum conductor according to the invention shows excellent noise level even if the lape of time is small.

EXAMPLE 4

The samples of EXAMPLE 3 were subjected to a boehmite treatment by dipping these samples for ten minutes in a water solution of 0.5 vol. % triethanole amine maintained at temperature of above 95° C. so that samples A', B', C', D', E', F' and G' were prepared. The audible noise level of these samples were measured three minutes after stopping the water spraying in the manner as described above for EXAMPLE 3. The results obtained were shown in Table 3.

TABLE 3

| Sample | Audible noise level [dB (A)] |
|---|---|
| A' | 39 |
| B' | 58 |
| C' | 40 |
| D' | 40 |
| E' | 62 |
| F' | 39 |
| G' | 42 |

As is clear from Table 3, sample A', which was subjected to the test immediately after the boehmite film was formed on the surface, shows excellent noise level of 39 dB(A), but when it is stored for a long time (six months in the case of the test), the noise level is degraded to 58 dB(A), as seen from sampel B'. On the other hand, samples C', D', F' and G', which have the protective film of wetting agent or of a hydrophilic nature on the hydrophilic film on the conductor surface, retain excellent noise levels of 40, 40, 39 and 42 dB(A), respectively, for a prolonged period of time even if they are stored for a long time (six months in the case of the test).

When sodium dodecyl benzene sulfonate (Neopelex F25 sold by Kao Atlas Chemical Co., Ltd.), lauryl sulfate triethanole amine (Emal AD sold by Kao Atlas Chemical Co., Ltd.) polyoxyethylene oleyl ether (Emulgen 404), polyoxy ethylene nonyl phenol ether (Emulgen 905 sold by Kao Atlas Chemical Co., Ltd.), and polyvinyl alcohol resin tape (Tocero ET-20 sold by Tokyo Cerohanshi Co., Ltd.) for lapping were used respectively as the wetting agent or the hydrophilic resin forming the protective film, the above advantageous effects were achieved.

EXAMPLE 5

ACSR A of 240 $mm^2$ cross-section, ACSR B of 410 $mm^2$, ACSR C of 610 $mm^2$ and ACSR D of 810 $mm^2$ were compressed at respective reduction rates of 17.2%, 19.6%, 10.2% and 7.9% to prepare the four compressed ACSRs. The compressing operation was carried out by means of the perpendicularly disposed two pairs of rolls. These compressed ACSRs were subjected for 10 seconds to dry blasting using #100 alumina powder to have a roughened surface, and were exposed to steam of 110° C. for 30 minutes in a pressure vessel to form a hydrophilic film on the respective surfaces, thereby preparing samples $A_1$, $B_1$, $C_1$ and $D_1$. ACSRs A, B, C and D were subjected for 10 seconds to dry blasting using #100 alumina powder to have a roughened surface, and were exposed to steam of 110° C. for 30 minutes in a pressure vessel to form a hydrophic film on the respective surfaces, thereby preparing comparison samples $A_2$, $B_2$, $C_2$ and $D_2$. ACSRs A, B, C and D, which were subjected to no treatment, were also used as comparison samples $A_3$, $B_3$, $C_3$ and $D_3$. All these samples were energized and water was sprayed thereto at a rate of 30 mm/hour by a cylindrical corona test cage. The audible noise level of these samples three minutes after stopping the spraying was measured, varying a surface voltage gradient. The results obtained were shown in Table 4.

TABLE 4

| Sample | | Surface voltage gradient (KV/cm) | | | | | |
|---|---|---|---|---|---|---|---|
| | | 10 | 12 | 14 | 16 | 18 | 20 |
| A | $A_3$ | 39 dB (A) | 43 dB (A) | 50 dB (A) | 63 dB (A) | 67 dB (A) | 71 dB(A) |
| | $A_2$ | — | — | 36 | 51 | 62 | 70 |
| | $A_1$ | — | — | — | 44 | 52 | 55 |
| B | $B_3$ | 40 | 48 | 53 | 63 | 69 | 73 |
| | $B_2$ | — | — | 37 | 56 | 67 | 73 |
| | $B_1$ | — | — | — | 47 | 56 | 60 |
| C | $C_3$ | 36 | 48 | 57 | 66 | 73 | 77 |
| | $C_2$ | — | 36 | 43 | 64 | 73 | 78 |
| | $C_1$ | — | — | 37 | 52 | 57 | 68 |
| D | $D_3$ | 47 | 58 | 66 | 72 | 80 | 85 |
| | $D_2$ | 36 | 37 | 43 | 72 | 81 | 83 |
| | $D_1$ | — | — | 39 | 55 | 64 | 70 |

(The noise level below 35 dB(A) was incapable of measurement and is indicated by "—")

As seen from Table 4, as to the non-treated samples $A_3$, $B_3$, $C_3$ and $D_3$, the audible noise level is on the whole high at the surface voltage gradient of 10 to 20 KV/cm. Samples $A_2$, $B_2$, $C_2$ and $D_2$, which were subjected to the roughening and hydrophilic treatments, exhibits substantially no audible noise at the surface voltage gradient of up to 12 KV/cm, and shows a lower audible noise level at the voltage gradient of 14 to 20 KV/cm than samples $A_3$, $B_3$, $C_3$ and $D_3$. Thus, samples $A_2$, $B_2$, $C_2$ and $D_2$ have advantageous effects. But, samples $A_1$, $B_1$, $C_1$ and $D_1$ of the compressed ACSRs produce substantially no audible noise at the surface voltage gradient of up to about 14 KV/cm, and at the gradient of more than 14 KV/cm, show a lower noise level than the other samples. Thus, samples $A_1$, $B_1$, $C_1$ and $D_1$ exhibit the best results.

What is claimed is:

1. A process for treating the surface of a transmission line aluminum conductor in order to reduce generation of audible noise in said conductor due to corona discharge, said process comprising the steps of:

blasting the surface of an aluminum conductor to roughen it to a roughness layer having a thickness of about 3 to 300 microns;

forming a non-porous boehmite film by steam treatment on the roughened surface at temperatures within the range between 100° and 120° C. for a period of time between 0.5 and 20 minutes to impart a hydrophilic nature to said surface such that the conductor wets uniformly upon receipt of water, said film being not thicker than 2 microns; and forming a second film on said boehmite film by applying a wetting agent on said boehmite film.

2. A process according to claim 1 wherein said wetting agent is selected from the group consisting of alkylsulfate, alkylbenzene sulfonate, polyoxy ethylene alkyl ether and polyoxy ethylene alkyl phenol ether wetting agents.

* * * * *

UNITED STATES PATENT AND TRADEMARK OFFICE

CERTIFICATE OF CORRECTION

PATENT NO. : 4,759,805

DATED : July 26, 1988

INVENTOR(S) : KOHICHI SARUWATARI ET AL.

It is certified that error appears in the above-identified patent and that said Letters Patent are hereby corrected as shown below:

Title page, Related U.S. Application Data, Item [63], after "Ser. No. 603,995, Apr. 26, 1984,", change "Pat. No. 4,759,805" to -- abandoned --.

Signed and Sealed this

Twenty-fourth Day of January, 1989

*Attest:*

DONALD J. QUIGG

*Attesting Officer*

*Commissioner of Patents and Trademarks*